US010384890B2

(12) United States Patent
Matsuoka et al.

(10) Patent No.: US 10,384,890 B2
(45) Date of Patent: Aug. 20, 2019

(54) PAPER FEEDING DEVICE

(71) Applicants: KABUSHIKI KAISHA TOSHIBA, Tokyo (JP); TOSHIBA TEC KABUSHIKI KAISHA, Tokyo (JP)

(72) Inventors: Kei Matsuoka, Kawasaki Kanagawa (JP); Shinichi Tatsuta, Taito Tokyo (JP); Shunsuke Hattori, Kawasaki Kanagawa (JP); Takamitsu Sunaoshi, Yokohama Kanagawa (JP); Yusuke Hashizume, Urayasu Chiba (JP); Masakazu Iwamoto, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/911,361

(22) Filed: Mar. 5, 2018

(65) Prior Publication Data

US 2019/0106284 A1 Apr. 11, 2019

(30) Foreign Application Priority Data

Oct. 10, 2017 (JP) ..... 2017-197094

(51) Int. Cl.
*B65H 3/14* (2006.01)
*B65H 3/48* (2006.01)
(Continued)

(52) U.S. Cl.
CPC ..... *B65H 3/14* (2013.01); *B65H 1/225* (2013.01); *B65H 3/48* (2013.01); *B65H 3/62* (2013.01);
(Continued)

(58) Field of Classification Search
CPC ... B65H 1/04; B65H 1/14; B65H 1/18; B65H 3/08; B65H 3/14; B65H 3/48; B65H 3/66;
(Continued)

(56) References Cited

U.S. PATENT DOCUMENTS 4,364,550 A * 12/1982 Hynes ..... B65H 3/14 271/11
6,015,144 A 1/2000 Yoshii et al.
7,802,785 B2 * 9/2010 Kobayashi ..... B65H 1/24 271/146
2009/0121411 A1 5/2009 Kosugi et al.
(Continued)

FOREIGN PATENT DOCUMENTS

EP 0361259 A1 4/1990
JP 61-243745 A 10/1986
(Continued)

OTHER PUBLICATIONS

Extended European Search Report dated Mar. 8, 2019, filed in counterpart European Patent Application No. 18198826.2, 7 pages.

*Primary Examiner* — Prasad V Gokhale
(74) *Attorney, Agent, or Firm* — Kim & Stewart LLP

(57) ABSTRACT

A paper feeding device of an embodiment includes a paper feed tray, a blower, and a flow regulating member. A paper bundle in which a plurality of sheets of paper are stacked can be placed on the paper feed tray. The blower is positioned next to the paper bundle placed on the paper feed tray. The blower can generate airflow. The flow regulating member is positioned above the paper bundle placed on the paper feed tray. The airflow from the blower causes the flow regulating member to generate a negative pressure between the flow regulating member and the uppermost sheet of paper of the paper bundle.

15 Claims, 10 Drawing Sheets

(51) Int. Cl.

| | |
|---|---|
| ***B65H 1/22*** | (2006.01) |
| ***G03G 15/00*** | (2006.01) |
| ***B65H 3/62*** | (2006.01) |
| ***B65H 7/16*** | (2006.01) |
| ***B65H 7/02*** | (2006.01) |

(52) U.S. Cl.
CPC ..... *B65H 7/02* (2013.01); *B65H 7/16* (2013.01); *G03G 15/6511* (2013.01); *B65H 2301/5133* (2013.01); *B65H 2301/5321* (2013.01); *B65H 2407/311* (2013.01); *B65H 2515/40* (2013.01); *B65H 2515/716* (2013.01); *B65H 2515/805* (2013.01); *G03G 2215/00396* (2013.01)

(58) Field of Classification Search
CPC ... B65H 7/02; B65H 7/16; B65H 7/20; B65H 2301/5133; B65H 2301/5321; B65H 2406/12; B65H 2406/121; B65H 2407/311; B65H 2515/40; B65H 2515/716; B65H 2515/805
See application file for complete search history.

(56) References Cited

U.S. PATENT DOCUMENTS

| | | | | |
|---|---|---|---|---|
| 2009/0302522 | A1* | 12/2009 | Fujimori | B65H 3/06 271/9.08 |
| 2012/0275805 | A1 | 11/2012 | Nagai | |
| 2014/0061999 | A1* | 3/2014 | Okamoto | B65H 3/08 271/11 |
| 2016/0068358 | A1* | 3/2016 | Yabuki | B65H 3/48 399/16 |
| 2018/0150006 | A1* | 5/2018 | Furuichi | G03G 15/6511 |
| 2018/0327202 | A1* | 11/2018 | Nakamura | B65H 3/128 |

FOREIGN PATENT DOCUMENTS

| | | | |
|---|---|---|---|
| JP | H01-38096 | Y2 | 11/1989 |
| JP | H06-107347 | A | 4/1994 |
| JP | 2002-503192 | A | 1/2002 |
| JP | 2005-112560 | A | 4/2005 |
| JP | 2007-055786 | A | 3/2007 |
| JP | 41-54299 | B2 | 9/2008 |
| JP | 2010-058917 | A | 3/2010 |

* cited by examiner

PAPER FEEDING DEVICE

CROSS-REFERENCE TO RELATED APPLICATION

This application is based upon and claims the benefit of priority from the prior Japanese Patent Application No. 2017-197094, filed on Oct. 10, 2017, the contents of which are incorporated herein by reference in their entirety.

FIELD

Embodiments described herein relate generally to a paper feeding device.

BACKGROUND

A paper feeding device includes a paper feed tray. A paper bundle in which a plurality of sheets of paper are stacked can be placed on the paper feed tray. For example, a pickup roller may come into contact with an upper surface of the paper bundle placed on the paper feed tray. When the pickup roller rotates, the paper is fed out of the paper feed tray.

Meanwhile, in a paper feeding device, it is necessary to convey one sheet of paper at a time from a paper bundle placed on a paper feed tray. In the paper bundle placed on the paper feed tray, it is necessary to separate an uppermost sheet of paper (hereinafter referred to as an "uppermost sheet of paper") from the paper bundle to prevent paper from being sent out in a state in which a plurality of sheets are overlapping (multiple feeding).

DETAILED DESCRIPTION

Figure 1:
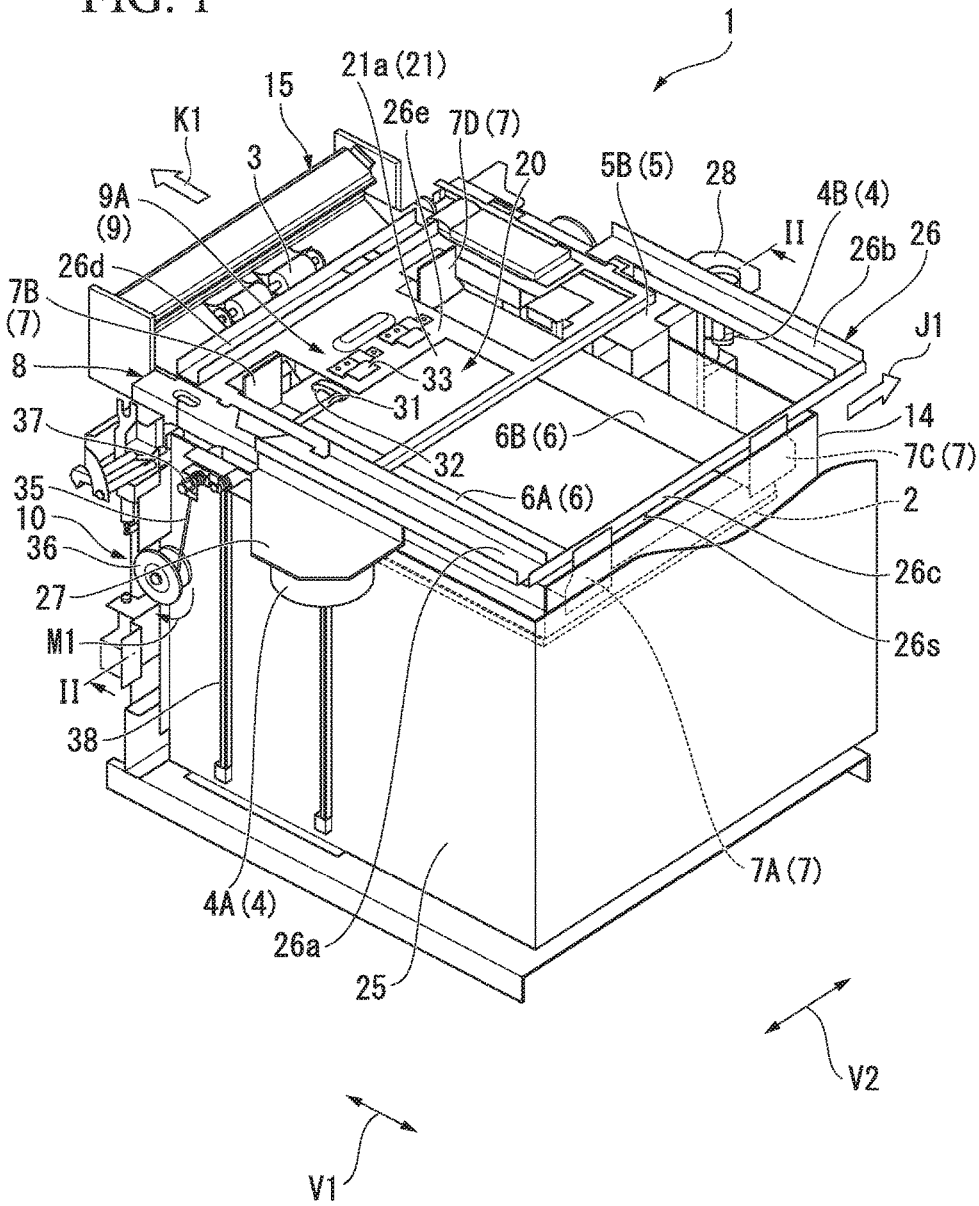
FIG. 1 is a perspective view showing a paper feeding device of an embodiment.

A paper feeding device of an embodiment includes a paper feed tray, a blower, and a flow regulating member. A paper bundle in which a plurality of sheets of paper are stacked can be placed on the paper feed tray. The blower is positioned next to the paper bundle placed on the paper feed tray. The blower can generate an airflow. The flow regulating member is positioned above the paper bundle placed on the paper feed tray. The airflow from the blower causes the flow regulating member to generate a negative pressure between the flow regulating member and an uppermost sheet of paper of the paper bundle.

Hereinafter, a paper feeding device according to an embodiment will be described with reference to the drawings. In each of the drawings, the same components are designated by the same reference characters.

A paper feeding device will be described.

Figure 2:
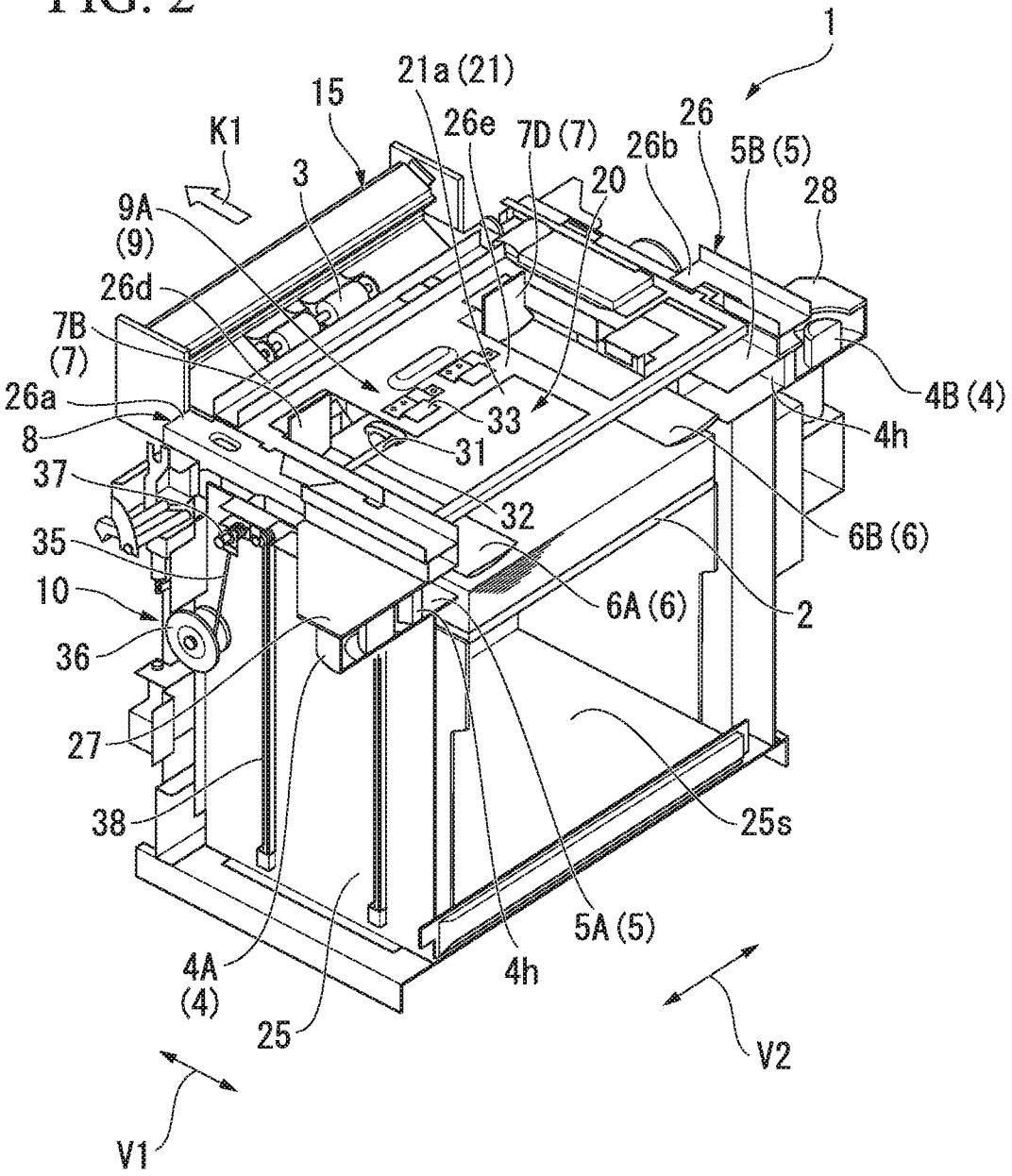
FIG. 2 is a perspective view showing a cross section of a main portion of the paper feeding device of the embodiment.
Figure 3:
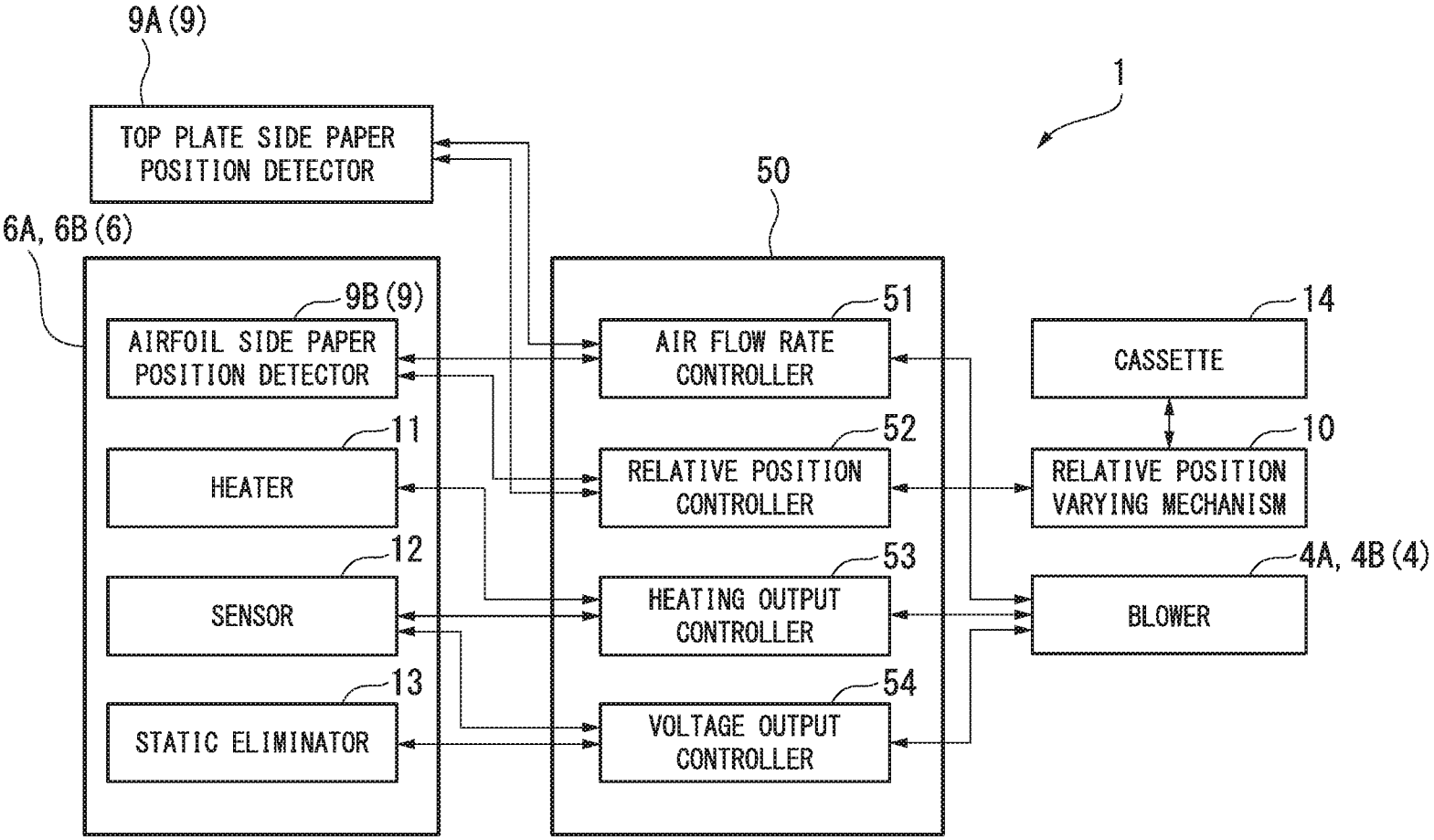
FIG. 3 is a block diagram showing a configuration of the paper feeding device of the embodiment.

FIG. 1 is a perspective view showing a paper feeding device 1 of the embodiment. FIG. 2 is a perspective view showing a cross section of a main portion of the paper feeding device 1 of the embodiment. FIG. 3 is a block diagram showing a configuration of the paper feeding device 1 of the embodiment. FIG. 2 is a view including a cross section taken along line II-II of FIG. 1.

As shown in FIG. 1, the paper feeding device 1 includes a paper feed tray 2, a pickup roller 3, a blower 4, a duct 5, a flow regulating member 6, a blocking member 7, a frame 8, a paper position detection unit 9, a relative position varying mechanism 10, a heater 11 (see FIG. 3), a sensor 12 (see FIG. 3), a static eliminator 13 (see FIG. 3), and a system control unit 50 (see FIG. 3). For example, the paper feeding device 1 is mounted in an image forming device such as a printer.

The paper feed tray 2 will be described.

As shown in FIG. 1, a paper bundle 20 in which a plurality of sheets of paper are stacked can be placed on the paper feed tray 2. The paper is a sheet shaped recording medium. The paper feed tray 2 supports the paper bundle 20 from below. The paper feed tray 2 has a rectangular plate shape corresponding to paper sizes. The paper feed tray 2 has a longitudinally-extending part in a paper conveying direction K1 (hereinafter referred to as a "paper conveying direction K1"). The paper feed tray 2 feeds unused paper to outside by the pickup roller 3. The paper feed tray 2 is disposed in a box-shaped cassette 14 which opens upward. The cassette 14 can be taken out from the paper feeding device 1 in a direction of arrow J1.

The pickup roller 3 will be described.

As shown in FIG. 1, the pickup roller 3 takes out paper from the cassette 14. The pickup roller 3 is positioned on a downstream side in the paper conveying direction K1 of an upper portion of the paper bundle 20 placed on the paper feed tray 2. The pickup roller 3 is in contact with an upper surface 21*a* of the paper bundle 20 placed on the paper feed tray 2. The pickup roller 3 is connected to a drive mechanism 15 including a motor and the like. When the pickup roller 3 is rotated by an operation of the drive mechanism 15, paper is fed out of the paper feed tray 2.

The blower 4 will be described.

As shown in FIG. 1, the blower 4 is positioned next to the paper bundle 20 placed on the paper feed tray 2. The blower 4 can generate airflow. In the embodiment, the blowers 4 are disposed next to the both sides of the paper bundle 20 placed on the paper feed tray 2 in a width direction of the paper (hereinafter referred to as a "paper width direction") perpendicular to the paper conveying direction K1 and parallel to the upper surface 21*a* of the paper. Each of the blowers 4 is positioned at a center in a longitudinal direction of the paper. The blowers 4 are fixed at fixed positions.

Hereinafter, one of the blowers 4 positioned on one side of the paper bundle 20 placed on the paper feed tray 2 is referred to as a "first blower 4A" and the other of the blowers 4 positioned on the other side of the paper bundle 20 placed on the paper feed tray 2 is referred to as a "second blower 4B." Each of the blowers 4A and 4B is disposed so that a blower opening 4*h* (see FIG. 2) faces the paper bundle 20.

The duct 5 will be described.

As shown in FIG. 2, the duct 5 guides airflow generated by the blowers 4 from the side of the paper bundle 20 placed on the paper feed tray 2 toward the paper bundle 20. In the embodiment, the ducts 5 are disposed next to the both sides of the paper bundle 20 placed on the paper feed tray 2 in the paper width direction.

Hereinafter, one of the ducts 5 positioned on one side of the paper bundle 20 placed on the paper feed tray 2 is referred to as a "first duct 5A" and the other of the ducts 5 positioned on the other side of the paper bundle 20 placed on the paper feed tray 2 is referred to as a "second duct 5B."

The first duct 5A guides the airflow generated by the first blower 4A from the one side toward the paper bundle 20. The first duct 5A forms a flow path of the airflow reaching the paper side from the blower opening 4*h* of the first blower 4A.

The second duct 5B guides the airflow generated by the second blower 4B from the other side toward the paper bundle 20. The second duct 5B forms a flow path of the airflow reaching the paper side from the blower opening 4*h* of the second blower 4B.

The flow regulating member 6 will be described.

As shown in FIG. 2, the flow regulating member 6 is positioned above the paper bundle 20 placed on the paper feed tray 2. The airflow from the blowers 4 causes the flow regulating member 6 to generate a negative pressure between the flow regulating member 6 and the uppermost sheet of paper 21 of the paper bundle 20. The flow regulating member 6 is fixed at a fixed position. A plurality of flow regulating members 6 are disposed above the paper bundle 20 placed on the paper feed tray 2. The plurality of flow regulating members 6 are disposed on opposite sides in the paper width direction above the paper bundle 20. The plurality of flow regulating members 6 are a first flow regulating member 6A and a second flow regulating member 6B.

The first flow regulating member 6A is positioned next to the first blower 4A. Airflow from the first blower 4A causes the first flow regulating member 6A to generate a negative pressure between the first flow regulating member 6A and the uppermost sheet of paper 21.

The second flow regulating member 6B is positioned next to the second blower 4B. Airflow from the second blower 4B causes the second flow regulating member 6B to generate a negative pressure between the second flow regulating member 6B and the uppermost sheet of paper 21.

Each of the flow regulating members 6 has an airfoil shape. For example, the flow regulating member 6 has a shape which is inverted upside down from a wing (main wing) of an airplane. The flow regulating member 6 has a continuous airfoil shape without any gap. As shown in FIG. 1, the flow regulating member 6 extends in a direction parallel to the paper conveying direction K1 (hereinafter also referred to as a "first direction V1"). The flow regulating member 6 extends in a direction parallel to the longitudinal direction of the paper. The flow regulating member 6 extends in a direction parallel to the upper surface 21*a* of the uppermost sheet of paper 21. The flow regulating member 6 continuously extends in the first direction V1.

Figure 4:
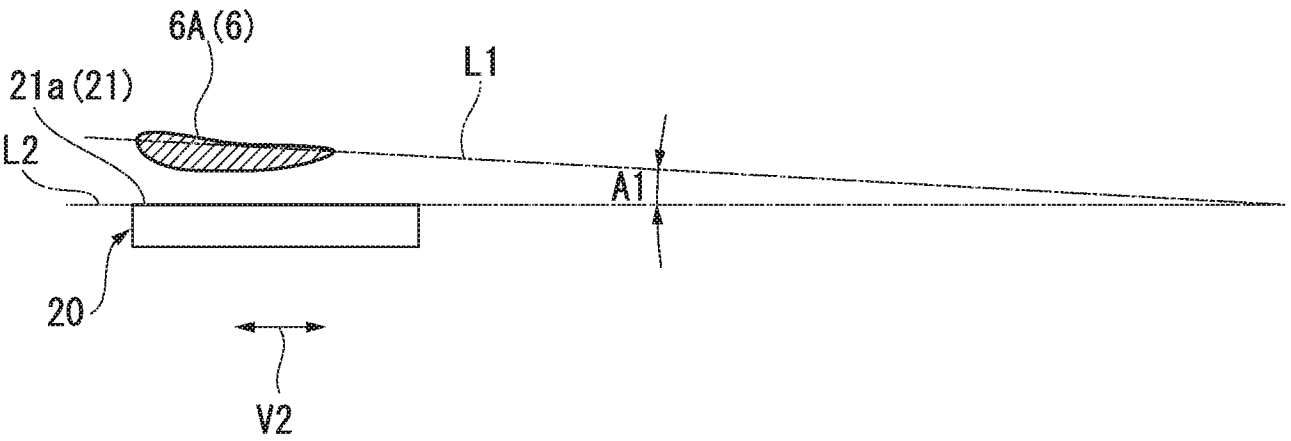
FIG. 4 is a view showing a flow regulating member of the embodiment together with a paper bundle.

FIG. 4 is a view showing the flow regulating member 6 of the embodiment together with the paper bundle 20. FIG. 4 corresponds to a cross-sectional view of the flow regulating member 6 taken along line II-II of FIG. 1 when viewed from the first direction V1. In FIG. 4, the paper feed tray 2, the blower 4, and the like are omitted. In the following description, the first flow regulating member 6A will be described. The second flow regulating member 6B is the same as the first flow regulating member 6A, and thus a description thereof will be omitted.

As shown in FIG. 4, the first flow regulating member 6A is disposed to be spaced apart from the uppermost sheet of paper 21 of the paper bundle 20. A lower portion of the first flow regulating member 6A faces the upper surface 21*a* of the uppermost sheet of paper 21. Hereinafter, a portion of the first flow regulating member 6A which is close to the first blower 4A is referred to as a "front side" and a portion of the first flow regulating member 6A which is close to the second blower 4B is referred to as a "rear side." The first flow regulating member 6A is slightly curved to protrude downward with respect to a line connecting a front side end (a front edge) and a rear side end (a rear edge) (hereinafter referred to as a "chord line L1"). The first flow regulating member 6A bulges slightly above a chord line L1 at a front end portion.

An elevation angle A1 of the first flow regulating member 6A is positive. Here, the elevation angle A1 is a value representing an angle at which the first flow regulating member 6A is tilted with respect to a flow of airflow from the first blower 4A. The elevation angle A1 is an angle formed by the chord line L1 and a virtual line L2 passing through the upper surface 21*a* of the uppermost sheet of paper 21. When the chord line L1 being parallel to the virtual line L2 is taken as a reference, when the front is tilted up, the elevation angle A1 is referred to as being positive. When the elevation angle A1 is positive, a negative pressure tends to be generated between the upper surface 21*a* of the uppermost sheet of paper 21 and the first flow regulating member 6A.

The blocking member 7 will be described.

As shown in FIG. 1, the blocking members 7 are provided at opposite ends of the flow regulating member 6. The blocking members 7 block the airflow from the blowers 4. The blocking members 7 restrict a flow of airflow so that the airflow passes between the upper surface 21*a* of the uppermost sheet of paper 21 and the flow regulating member 6 in regions in which the flow regulating members 6 are installed. The blocking members 7 have a plate shape parallel to a virtual plane (a vertical plane) perpendicular to an extending direction of the flow regulating members 6. A plurality of blocking members 7 are provided in each of the first flow regulating member 6A and the second flow regulating member 6B.

Hereinafter, the blocking member 7 provided at one end of the first flow regulating member 6A is referred to as a "first blocking member 7A," the blocking member 7 provided at the other end of the first flow regulating member 6A is referred to as a "second blocking member 7B," the blocking member 7 provided at one end of the second flow regulating member 6B is referred to as a "third blocking member 7C," and the blocking member 7 provided at the other end of the second flow regulating member 6B is referred to as a "fourth blocking member 7D."

The frame 8 will be described.

As shown in FIG. 1, the frame 8 is a member forming a framework of the paper feeding device 1. The frame 8 supports each element of the paper feeding device 1. The frame 8 includes a main body frame 25 and an upper frame 26.

The main body frame 25 supports the upper frame 26 from below. A space 25*s* (see FIG. 2) in which the cassette 14 is vertically movable is formed inside the main body frame 25.

The upper frame 26 supports the blower 4, the duct 5 and the flow regulating member 6. The upper frame 26 includes a first beam 26*a*, a second beam 26*b*, a first connecting beam 26*c*, a second connecting beam 26*d*, and a connecting top plate 26*e*. A gap for discharging airflow from the blower 4 to the outside is provided between the upper frame 26 and the cassette 14.

The first beam 26*a* is positioned next to the first blower 4A above the paper bundle 20 placed on the paper feed tray 2. The first beam 26*a* extends in the first direction V1. As shown in FIG. 2, the first beam 26*a* supports the first blower 4A and the first duct 5A via a first bracket 27.

As shown in FIG. 1, the second beam 26*b* is positioned next to the second blower 4B above the paper bundle 20 placed on the paper feed tray 2. The second beam 26*b* extends in a direction parallel to the first beam 26*a*. The second beam 26*b* supports the second blower 4B and the second duct 5B via a second bracket 28.

The first connecting beam 26*c* is positioned on an upstream side in the paper conveying direction K1 above the paper bundle 20 placed on the paper feed tray 2. The first connecting beam 26*c* connects the first beam 26*a* and the second beam 26*b* on a position opposite to the pickup roller 3. The first connecting beam 26*c* extends in a direction parallel to the paper width direction (hereinafter also referred to as a "second direction V2"). The first connecting beam 26*c* supports one end of the first flow regulating member 6A via the first blocking member 7A. The first connecting beam 26*c* supports one end of the second flow regulating member 6B via the third blocking member 7C.

The second connecting beam 26*d* is positioned on the downstream side in the paper conveying direction K1 above the paper bundle 20 placed on the paper feed tray 2. The second connecting beam 26*d* connects the first beam 26*a* and the second beam 26*b* at a position next to the pickup roller 3. The second connecting beam 26*d* extends in a direction parallel to the first connecting beam 26*c*.

The connecting top plate 26*e* is positioned on a downstream side in the paper conveying direction K1 above the paper bundle 20 placed on the paper feed tray 2. The connecting top plate 26*e* connects the first beam 26*a* and the second beam 26*b* at a position next to the second connecting beam 26*d*. The connecting top plate 26*e* supports the other end of the first flow regulating member 6A via the second blocking member 7B. The connecting top plate 26*e* supports the other end of the second flow regulating member 6B via the fourth blocking member 7D.

The paper position detection unit 9 will be described.

As shown in FIG. 1, the paper position detection unit 9 can detect a position of the uppermost sheet of paper 21. A plurality of paper position detection units 9 are provided in each of the connecting top plate 26*e* and the flow regulating member 6. Hereinafter, the paper position detection unit 9 provided on the connecting top plate 26*e* is referred to as a "top plate side paper position detector 9A," and the paper position detection unit 9 provided in the flow regulating member 6 is referred to as a "airfoil side paper position detector 9B" (See FIG. 3).

The top plate side paper position detector 9A will be described.

As shown in FIG. 1, the top plate side paper position detector 9A includes a shaft 31, a contact claw 32, and an infrared sensor 33. For example, the top plate side paper position detector 9A is a contact type displacement sensor.

The shaft 31 extends in the second direction V2. Opposite ends of the shaft 31 are respectively connected to the first beam 26*a* and the second beam 26*b*. Further, the shaft 31 may function as a movable shaft when the pickup roller 3 moves vertically. In addition, a power transmission mechanism (not shown) such as a belt and a gear which transmits power for rotating the pickup roller 3 may be attached to the shaft 31.

The contact claw 32 is rotatably attached to the shaft 31. The contact claw 32 is constantly in contact with the upper surface 21*a* of the uppermost sheet of paper 21 due to a force-applying member (not shown). A vertical movement of the paper feed tray 2 on which the paper bundle 20 is placed causes the contact claw 32 to rotate around the shaft 31 and vertically move together with the upper surface 21*a* of the uppermost sheet of paper 21.

The infrared sensor 33 detects a position of the contact claw 32. The infrared sensor 33 detects the position of the uppermost sheet of paper 21 by detecting the position of the contact claw 32.

A detection result of the top plate side paper position detector 9A is sent to the system control unit 50.

The airfoil side paper position detector 9B will be described.

As shown in FIG. 3, the airfoil side paper position detector 9B is embedded in the flow regulating member 6. The airfoil side paper position detector 9B is provided in each of the first flow regulating member 6A and the second flow regulating member 6B. For example, the airfoil side paper position detector 9B is a non-contact displacement sensor such as a camera and an infrared sensor. The airfoil side paper position detector 9B detects the position of the uppermost sheet of paper 21 from a lower surface side of the flow regulating member 6. A detection result of the airfoil side paper position detector 9B is sent to the system control unit 50.

The relative position varying mechanism 10 will be described.

As shown in FIG. 1, the relative position varying mechanism 10 can change the relative position between the flow regulating member 6 and the paper feed tray 2. The relative position varying mechanism 10 is provided in the main body frame 25. The relative position variable mechanism 10 can change the distance between the upper surface 21*a* of the uppermost sheet of paper 21 and the flow regulating member 6. In the embodiment, the relative position varying mechanism 10 changes the distance between the upper surface 21*a* of the uppermost sheet of paper 21 and the flow regulating member 6 by vertically moving the cassette 14 in a state in which the flow regulating member 6 is in a fixed position.

The relative position varying mechanism 10 includes a wire 35, a tensioner pulley 36, and an idler pulley 37.

One end of the wire 35 is attached to the tensioner pulley 36. The other end of the wire 35 is attached to a slider (not shown).

The tensioner pulley 36 is rotatable around an axis extending in the second direction V2.

The idler pulley 37 movably supports the wire 35. The idler pulley 37 allows vertical movement of the wire 35.

A slider (not shown) is attached to the cassette 14. A guide groove 38 extending vertically is provided on a side surface of the main body frame 25. The slider is slidably attached to the guide groove 38.

For example, when the tensioner pulley 36 rotates in a direction of arrow M1, the slide moves upward along the guide groove 38 to lift the cassette 14.

The heater 11 will be described.

As shown in FIG. 3, the heater 11 is provided in the flow regulating member 6. The heater 11 is provided in each of the first flow regulating member 6A and the second flow regulating member 6B. The heater 11 can heat the uppermost sheet of paper 21. For example, the heater 11 is a heater such as an infrared lamp heater and a halogen lamp heater. The heater 11 heats the uppermost sheet of paper 21 from the lower surface side of the flow regulating member 6.

The sensor 12 will be described.

As shown in FIG. 3, the sensor 12 is embedded in the flow regulating member 6. The sensor 12 is provided in each of the first flow regulating member 6A and the second flow regulating member 6B. The sensor 12 can detect a temperature and humidity of the uppermost sheet of paper 21. For example, the sensor 12 is a non-contact type temperature and humidity sensor. The sensor 12 detects the temperature and humidity of the uppermost sheet of paper 21 from the lower surface side of the flow regulating member 6. A detection result of the sensor 12 is sent to the system control unit 50.

The static eliminator 13 will be described.

As shown in FIG. 3, the static eliminator 13 is embedded in the flow regulating member 6. The static eliminator 13 is provided in each of the first flow regulating member 6A and the second flow regulating member 6B. The static eliminator 13 can remove static electricity of the uppermost sheet of paper 21. For example, the static eliminator 13 is an ionizer. The static eliminator 13 applies a high voltage to a discharge needle to cause corona discharge for ionization. The static eliminator 13 ionizes air between the upper surface 21*a* of the uppermost sheet of paper 21 and the flow regulating member 6 to remove the static electricity of the uppermost sheet of paper 21.

The system control unit 50 will be described.

As shown in FIG. 3, the system control unit 50 generally controls each element of the paper feeding device 1. The system control unit 50 includes an air flow rate controller 51, a relative position controller 52, a heating output controller 53, and a voltage output controller 54.

The air flow rate controller 51 will be described.

The air flow rate controller 51 controls an air flow rate of the blower 4 on the basis of a detection result of the paper position detection unit 9. The air flow rate controller 51 controls an air flow rate of each of the first blower 4A and the second blower 4B on the basis of respective detection results of the top plate side paper position detector 9A and the airfoil side paper position detector 9B.

For example, when the position of the uppermost sheet of paper 21 is higher than a preset threshold value (hereinafter referred to as a "position threshold value"), the air flow rate controller 51 decreases the air flow rate of the blower 4 so that an air flow rate flowing between the upper surface 21*a* of the uppermost sheet of paper 21 and the flow regulating member 6 decreases. When the position of the uppermost sheet of paper 21 is lower than the preset position threshold value, the air flow rate controller 51 increases the air flow rate of the blower 4 so that the air flow rate flowing between the upper surface 21*a* of the uppermost sheet of paper 21 and the flow regulating member 6 increases.

The relative position controller 52 will be described.

The relative position controller 52 controls the relative position varying mechanism 10 on the basis of the detection result of the paper position detection unit 9. The relative position controller 52 controls the relative position varying mechanism 10 on the basis of respective detection results of the top plate side paper position detector 9A and the airfoil side paper position detector 9B.

For example, when the position of the uppermost sheet of paper 21 is higher than the position threshold value, the relative position controller 52 controls the relative position varying mechanism 10 such that the cassette 14 (paper feed tray 2) is lowered to a regular position. When the position of the uppermost sheet of paper 21 is lower than the position threshold value, the relative position controller 52 controls the relative position varying mechanism 10 such that the cassette 14 is raised to the regular position.

For example, the relative position controller may control the relative position varying mechanism 10 such that the cassette 14 is raised every time the number of sheets of paper decreases by a predetermined number of sheets (for example, 20 sheets).

The heating output controller 53 will be described.

A signal related to the air flow rate of the blower 4 is sent to the heating output controller 53. The heating output controller 53 controls an output of the heater 11 such that it is in accordance with the air flow rate of the blower 4 on the basis of the detection result of the sensor 12.

For example, when humidity of the uppermost sheet of paper 21 is higher than a preset threshold value (hereinafter referred to as a "humidity threshold value"), the heating output controller 53 increases the output of the heater 11 to heat the uppermost sheet of paper 21. The heating output controller 53 decreases the output of the heater 11 when humidity of the uppermost sheet of paper 21 is lower than the humidity threshold value.

For example, when a temperature of the uppermost sheet of paper 21 is lower than a preset threshold value (hereinafter referred to as a "temperature threshold value"), the heating output controller 53 increases the output of the heater 11 to heat the uppermost sheet of paper 21. The heating output controller 53 decreases the output of the heater 11 when the temperature of the uppermost sheet of paper 21 is higher than the temperature threshold value.

For example, when the air flow rate of the blower 4 is higher than a preset threshold value (hereinafter referred to as an "air flow rate threshold value"), the heating output controller 53 increases the output of the heater 11 to heat the uppermost sheet of paper 21. The heating output controller 53 decreases the output of the heater 11 when the air flow rate of the blower 4 is lower than the air flow rate threshold value.

The voltage output controller 54 will be described.

A signal related to the air flow rate of the blower 4 is sent to the voltage output controller 54. The voltage output controller 54 controls an output of the static eliminator 13 such that it is in accordance with the air flow rate of the blower 4 on the basis of the detection result of the sensor 12.

For example, when humidity of the uppermost sheet of paper 21 is higher than the humidity threshold value, the voltage output controller 54 increases the output (voltage applied to the discharge needle) of the static eliminator 13 to improve ionization. When the humidity of the uppermost sheet of paper 21 is lower than the humidity threshold value, the voltage output controller 54 decreases the output of the static eliminator 13.

For example, when a temperature of the uppermost sheet of paper 21 is lower than the temperature threshold value, the voltage output controller 54 increases the output of the static eliminator 13 to improve the ionization. When the temperature of the uppermost sheet of paper 21 is higher than the temperature threshold value, the voltage output controller 54 decreases the output of the static eliminator 13.

For example, when the air flow rate of the blower 4 is higher than the air flow rate threshold value, the voltage output controller 54 increases the output of the static eliminator 13 to improve the ionization. When the air flow rate of the blower 4 is lower than the air flow rate threshold value, the voltage output controller 54 decreases the output of the static eliminator 13.

An arrangement of the blower 4 and the duct 5 will be described.

Figure 5:
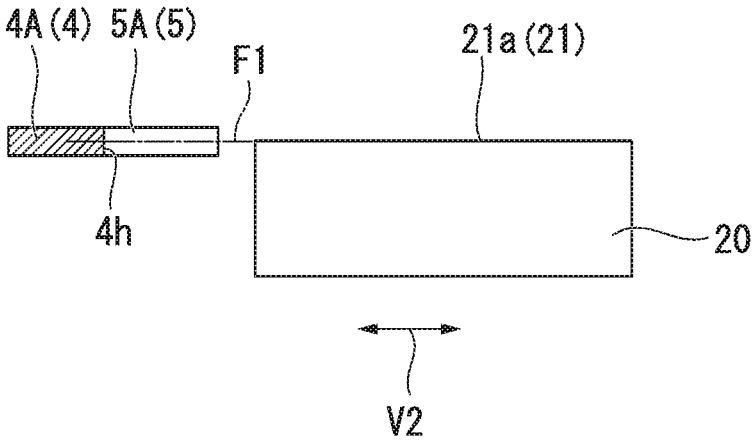
FIG. 5 is a view showing an arrangement of a blower and a duct of the embodiment.
Figure 6:
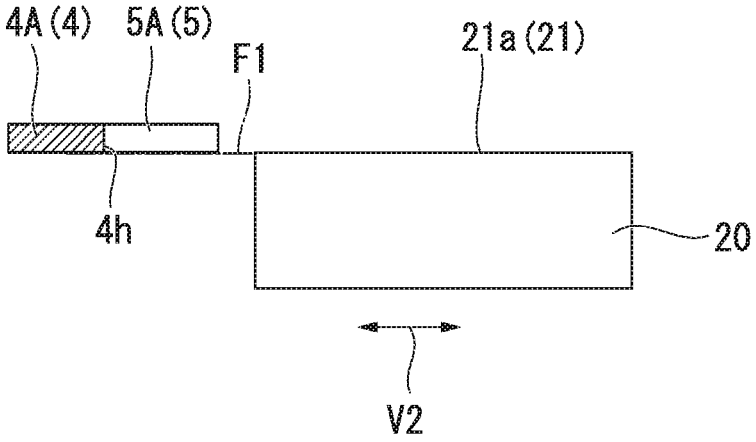
FIG. 6 is a view showing an operation due to the arrangement of the blower and the duct of the embodiment.

FIG. 5 is a view showing an arrangement of the blower 4 and the duct 5 of the embodiment. FIG. 6 is a view showing an operation due to the arrangement of the blower 4 and the duct 5 of the embodiment. In the following description, an arrangement of the first blower 4A and the first duct 5A will be described. Since an arrangement of the second blower 4B and the second duct 5B is the same as the arrangement of the first blower 4A and the first duct 5A, a description thereof will be omitted.

As shown in FIG. 5, the first blower 4A and the first duct 5A are disposed such that the blower opening 4*h* faces the upper portion of the paper bundle 20. The first blower 4A and the first duct 5A are disposed next to the upper surface 21*a* of the uppermost sheet of paper 21 of the paper bundle 20 in the second direction V2. In FIG. 5, reference character F1 shows a virtual plane including the upper surface 21*a* of the uppermost sheet of paper 21. In a side view of FIG. 5, a center of the blower opening 4*h* is disposed to overlap the virtual plane F1.

As shown in FIG. 6, the position of the uppermost sheet of paper 21 may be lower than a reference position (an initial position) in some cases. For example, as the paper conveying speed (hereinafter referred to as a "processing speed") increases, the position of the uppermost sheet of paper 21 tends to be lower. Although the relative position varying mechanism 10 (see FIG. 1) is provided, when raising the cassette 14 when the number of sheets of paper decreases by a predetermined number (for example, 20 sheets), the position of the uppermost sheet of paper 21 may be lower than the reference position while the number of sheets of paper has decreased by a predetermined number of sheets.

In a case in which a lower end of the blower opening 4*h* is assumed to be disposed to overlap the virtual plane F1, when the position of the uppermost sheet of paper 21 is lower than the reference position, there is a likelihood of the blower opening 4*h* being excessively separated from the upper surface 21*a* of the uppermost sheet of paper 21 in the vertical direction.

According to the embodiment, when the center of the blower opening 4*h* is disposed to overlap the virtual plane F1, even when the position of the uppermost sheet of paper 21 is lower than the reference position, the blower opening 4*h* remains close to the upper surface 21*a* of the uppermost sheet of paper 21 in the vertical direction (see FIG. 6). Therefore, even when the position of the uppermost sheet of paper 21 varies, it is possible to efficiently cause airflow between the upper surface 21*a* of the uppermost sheet of paper 21 and the flow regulating member 6.

A pressure distribution between the flow regulating member 6 and the uppermost sheet of paper 21 will be described.

Figure 7:
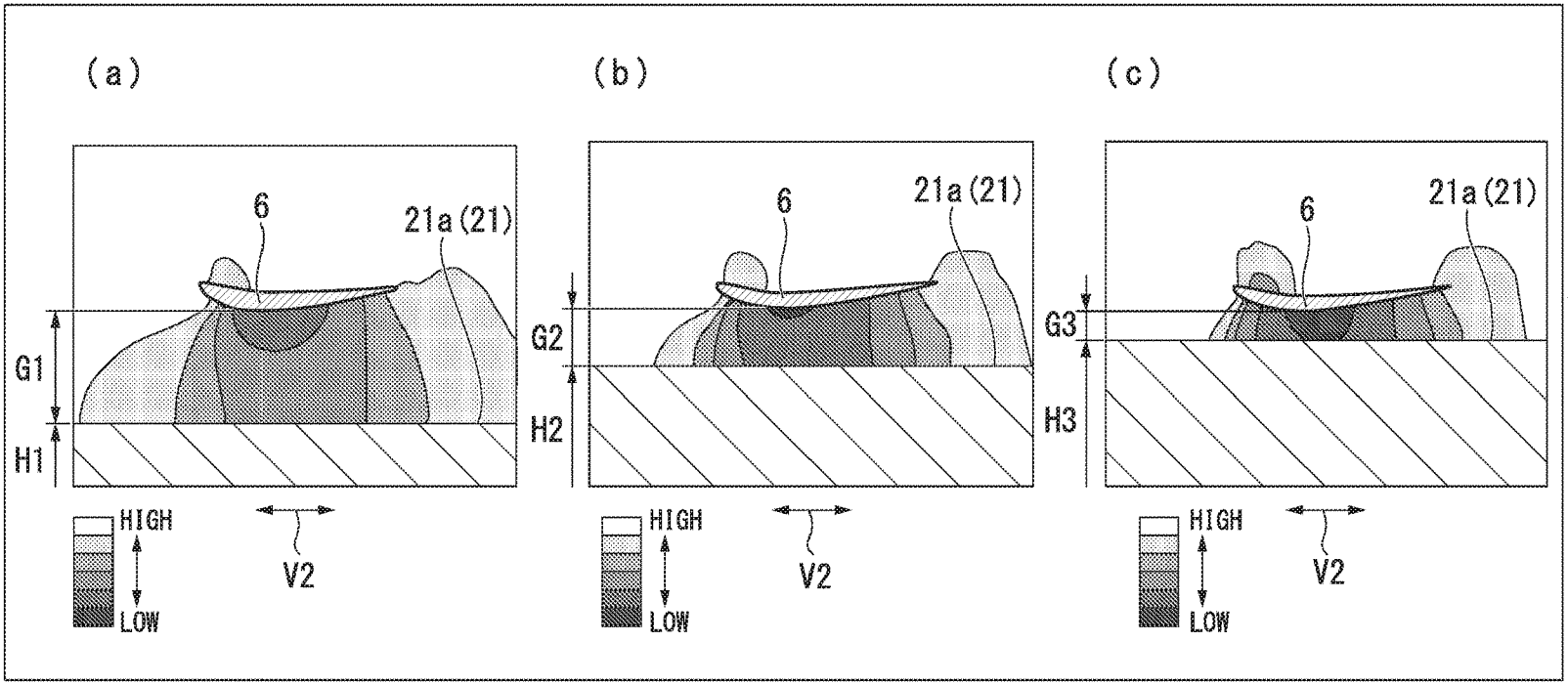
FIG. 7 is a view showing a pressure distribution between the flow regulating member and an uppermost sheet of paper in the embodiment, FIG. 7(*a*) is a view showing a pressure distribution when the uppermost sheet of paper is at a first height, FIG. 7(*b*) shows a pressure distribution when the uppermost sheet of paper is at a second height, and FIG. 7(*c*) shows a pressure distribution when the uppermost sheet of paper is at a third height.

FIG. 7 is a view showing a pressure distribution between the flow regulating member 6 and the uppermost sheet of paper 21 of the embodiment. FIG. 7(*a*) is a view showing a pressure distribution when the uppermost sheet of paper 21 is at a first height H1. FIG. 7(*b*) is a view showing a pressure distribution when the uppermost sheet of paper 21 is at a second height H2. FIG. 7(*c*) is a view showing a pressure distribution when the uppermost sheet of paper 21 is at a third height H3. Here, the first height H1, the second height H2, and the third height H3 have a relationship of H1<H2<H3. When the flow regulating member 6 is at the fixed position, distances G1, G2, and G3 between the upper surface 21*a* of the uppermost sheet of paper 21 and the flow regulating member 6 have a relationship of G1>G2>G3.

As shown in FIGS. 7A to 7C, a pressure of air between the upper surface 21*a* of the uppermost sheet of paper 21 and the flow regulating member 6 is lower than a pressure of a space above the flow regulating member 6. Between the upper surface 21*a* of the uppermost sheet of paper 21 and the flow regulating member 6, a pressure of air facing a lower center of the flow regulating member 6 is the lowest. As the distance between the upper surface 21*a* of the uppermost sheet of paper 21 and the flow regulating member 6 becomes smaller, the pressure of the air between the upper surface 21*a* of the uppermost sheet of paper 21 and the flow regulating member 6 decreases.

According to the embodiment, the paper feeding device 1 has the paper feed tray 2, the blower 4, and the flow regulating member 6. The paper bundle 20 in which a plurality of sheets of paper are stacked can be placed on the paper feed tray 2. The blower 4 is positioned next to the paper bundle 20 placed on the paper feed tray 2. The blower 4 can generate airflow. The flow regulating member 6 is positioned above the paper bundle 20 placed on the paper feed tray 2. The airflow from the blower 4 causes the flow regulating member 6 to generate a negative pressure between the flow regulating member 6 and the uppermost sheet of paper 21 of the paper bundle 20. With the above configurations, the following effects are achieved. Since the blower 4 is positioned next to the paper bundle 20 placed on the paper feed tray 2, it is possible to send airflow between the plurality of sheets of stacked paper as compared with a case in which the blower 4 is positioned above the paper bundle 20 placed on the paper feed tray 2. In addition, since the airflow from the blower 4 causes the flow regulating member 6 to generate a negative pressure between the flow regulating member 6 and the uppermost sheet of paper 21 of the paper bundle 20, the uppermost sheet of paper 21 can rise up. Therefore, it is possible to provide the paper feeding device 1 capable of separating the uppermost sheet of paper 21 from the paper bundle 20 placed on the paper feed tray 2.

In addition, since it is possible to reduce an influence of friction and contact between sheets of paper, the paper sheets can be easily taken out one by one. In addition, since a complicated structure such as a shutter mechanism is not required, the paper feeding device 1 can be simplified. In addition, since a large-sized fan for generating a large air flow rate is not required, the size of the blower 4 can be reduced. In addition, noise reduction can be achieved by reducing the output of the blower 4 (a rotation speed of a motor of the blower 4). In addition, the flow regulating member 6 can prevent the uppermost sheet of paper 21 from excessively rising upward.

Further, since the flow regulating member 6 has an airfoil shape, the following effects are achieved. It is easier to generate a high negative pressure (that is, a low pressure) between the flow regulating member 6 and the uppermost sheet of paper 21 as compared with a case in which the flow regulating member 6 has a flat plate shape. Therefore, the uppermost sheet of paper 21 can be easily separated from the paper bundle 20 placed on the paper feed tray 2.

In addition, since the flow regulating member 6 extends in a direction parallel to the paper conveying direction K1, the following effects are achieved. The flow regulating members 6 are easily disposed on opposite sides in the paper width direction as compared with a case in which the flow regulating member 6 extends in a direction perpendicular to the paper conveying direction K1. Therefore, an arrangement layout of the flow regulating member 6 can be improved.

In addition, since the flow regulating member 6 extends in a direction parallel to the longitudinal direction of the paper, the following effects are achieved. An inlet port of the airflow from the blower 4 can be wider between the flow regulating member 6 and the uppermost sheet of paper 21 as compared with a case in which the flow regulating member 6 extends in a direction parallel to a lateral direction of the paper. Therefore, the uppermost sheet of paper 21 easily rises up in a wide range.

Also, since the plurality of flow regulating members 6 are disposed above the paper bundle 20 placed on the paper feed tray 2, the following effects are achieved. The uppermost sheet of paper 21 easily rises up in a wide range as compared with a case in which only one flow regulating member 6 is disposed.

In addition, since the plurality of flow regulating members 6 are disposed on opposite sides in the paper width direction above the paper bundle 20, the following effects are achieved. The uppermost sheet of paper 21 tends to uniformly rise up as a whole as compared with a case in which a plurality of flow regulating members 6 are disposed only on one side in the paper width direction.

Further, the flow regulating member 6 extends in a direction parallel to the upper surface 21*a* of the uppermost sheet of paper 21. At opposite ends of the flow regulating member 6, the blocking members 7 which block the airflow from the blower 4 are provided. With the above configuration, the following effects are achieved. Since the airflow from the blower 4 can be blocked by the blocking members 7, it is possible to prevent the airflow from the blower 4 from being introduced into an unintended region. Therefore, the uppermost sheet of paper 21 can be stably separated from the paper bundle 20 placed on the paper feed tray 2.

In addition, since the airfoil side paper position detector 9B capable of detecting the position of the uppermost sheet of paper 21 is provided in the flow regulating member 6, the following effects are achieved. The position of the uppermost sheet of paper 21 can be ascertained by the airfoil side paper position detector 9B. In addition, since there is no need to separately provide an independent member for installing the airfoil side paper position detector 9B, it is possible to reduce the number of parts and costs.

In addition, since the airfoil side paper position detector 9B is embedded in the flow regulating member 6, the following effects are achieved. Flow regulating action of the airflow can be secured by the flow regulating member 6 as compared with a case in which the airfoil side paper position detector 9B is externally attached to the flow regulating member 6.

Also, since the paper feeding device 1 includes the air flow rate controller 51 which controls the air flow rate of the blower 4 on the basis of the detection result of the paper position detection unit 9, the following effects are achieved. Since the air flow rate of the blower 4 can be controlled according to the position of the uppermost sheet of paper 21, the uppermost sheet of paper 21 can be stably separated from the paper bundle 20 placed on the paper feed tray 2.

Incidentally, when the distance between the upper surface 21*a* of the uppermost sheet of paper 21 and the flow regulating member 6 is smaller, a force of raising the uppermost sheet of paper 21 is improved. For example, from a viewpoint of noise reduction, it is preferable to decrease the air flow rate of the blower 4 in a state in which the distance between the upper surface 21*a* of the uppermost sheet of paper 21 and the flow regulating member 6 is decreased. For example, from a viewpoint of stabilizing the airflow, it is preferable to increase the air flow rate of the blower 4 in a state in which the distance between the upper surface 21*a* of the uppermost sheet of paper 21 and the flow regulating member 6 is increased.

Further, since the paper feeding device 1 includes the relative position varying mechanism 10 capable of changing the relative position between the flow regulating member 6 and the paper feed tray 2, the following effects are achieved. Since the distance between the flow regulating member 6 and the uppermost sheet of paper 21 can be adjusted by the relative position varying mechanism 10, the uppermost sheet of paper 21 can be stably separated from the paper bundle 20 placed on the paper feed tray 2.

Further, the paper feeding device 1 includes the top plate side paper position detector 9A and the relative position controller 52. The top plate side paper position detector 9A can detect the position of the uppermost sheet of paper 21. The relative position controller 52 controls the relative position varying mechanism 10 on the basis of the detection result of the top plate side paper position detector 9A. With the above configuration, the following effects are achieved. The position of the uppermost sheet of paper 21 can be ascertained by the top plate side paper position detector 9A. In addition, since the distance between the flow regulating member 6 and the uppermost sheet of paper 21 can be adjusted according to the position of the uppermost sheet of paper 21, the uppermost sheet of paper 21 can be stably separated from the paper bundle 20 placed on the paper feed tray 2.

Also, since the heater 11 capable of heating the uppermost sheet of paper 21 is provided in the flow regulating member 6, the following effects are achieved. Since the uppermost sheet of paper 21 can be heated by the heater 11, moisture contained in the uppermost sheet of paper 21 can be evaporated. Therefore, it is possible to prevent sticking of the plurality of sheets of paper due to the moisture of the uppermost sheet of paper 21. In addition, since there is no need to separately provide an independent member for installing the heater 11, it is possible to reduce the number of parts and costs.

In addition, since the heater 11 is embedded in the flow regulating member 6, the following effects are achieved. Flow regulating action of the airflow can be secured by the flow regulating member 6 as compared with a case in which the heater 11 is externally attached to the flow regulating member 6.

Further, the paper feeding device 1 includes the sensor 12 and the heating output controller 53. The sensor 12 can detect a temperature and humidity of the uppermost sheet of paper 21. On the basis of the detection result of the sensor 12, the heating output controller 53 controls the output of the heater 11 such that it is in accordance with the air flow rate of the blower 4. With the above configuration, the following effects are achieved. The temperature and humidity of the uppermost sheet of paper 21 can be ascertained by the sensor 12. In addition, since the output of the heater 11 can be controlled to be in accordance with the air flow rate of the blower 4 corresponding to the temperature and humidity of the uppermost sheet of paper 21, the uppermost sheet of paper 21 can be stably separated from the paper bundle 20 placed on the paper feed tray 2. For example, when the air flow rate of the blower 4 is higher than the air flow rate threshold value, since the output of the heater 11 can be increased to heat the uppermost sheet of paper 21, the temperature of the uppermost sheet of paper 21 being lowered due to the airflow of the blower 4 can be prevented.

In addition, since the sensor 12 is embedded in the flow regulating member 6, the following effects are achieved. Flow regulating action of the airflow can be secured by the flow regulating member 6 as compared with a case in which the sensor 12 is externally attached to the flow regulating member 6.

Also, since the static eliminator 13 capable of removing the static electricity of the uppermost sheet of paper 21 is provided in the flow regulating member 6, the following effects are achieved. Since static electricity of the uppermost sheet of paper 21 can be removed by the static eliminator 13, it is possible to prevent sticking of the plurality of sheets of paper due to the static electricity of the uppermost sheet of paper 21. In addition, since there is no need to separately provide an independent member for installing the static eliminator 13, it is possible to reduce the number of parts and costs.

In addition, since the static eliminator 13 is embedded in the flow regulating member 6, the following effects are achieved. Flow regulating action of the airflow can be secured by the flow regulating member 6 as compared with a case in which the static eliminator 13 is externally attached to the flow regulating member 6.

Further, since the paper feeding device 1 includes the voltage output controller 54 which controls the output of the static eliminator 13 such that it is in accordance with the air flow rate of the blower 4 on the basis of the detection result of the sensor 12, the following effects are achieved. In addition, since the output of the static eliminator 13 can be controlled to be in accordance with the air flow rate of the blower 4 corresponding to the temperature and humidity of the uppermost sheet of paper 21, the uppermost sheet of paper 21 can be stably separated from the paper bundle 20 placed on the paper feed tray 2. For example, when the air flow rate of the blower 4 is higher than the air flow rate threshold value, since the output of the static eliminator 13 can be increased to improve the ionization, decrease in action of electrically charged air (static elimination effect) due to the airflow of the blower 4 can be minimized.

Modified examples of the embodiment will be described below.

A first modified example of the embodiment will be described.

In the embodiment, the case in which the flow regulating member 6 has an airfoil shape and bulges slightly above the chord line L1 at the front end portion has been described, but the present embodiment is not limited thereto.

Figure 8:
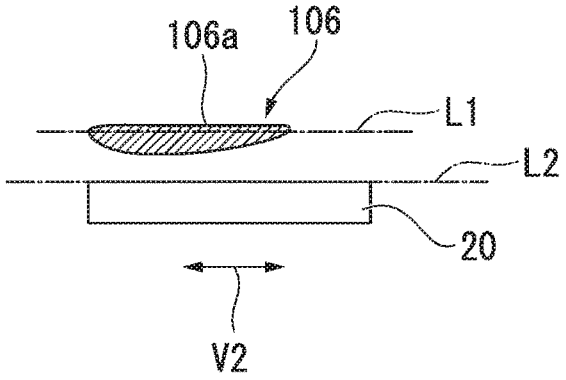
FIG. 8 is a view showing a flow regulating member of a first modified example of the embodiment together with a paper bundle.

FIG. 8 is a view showing a flow regulating member 106 of the first modified example of the embodiment together with the paper bundle 20. FIG. 8 corresponds to FIG. 4 in which a cross section of the flow regulating member 6 taken along line II-II of FIG. 1 is viewed from the first direction V1. In FIG. 8, the paper feed tray 2, the blower 4, and the like are omitted.

As shown in FIG. 8, the flow regulating member 106 has no bulging portion bulging slightly above the chord line L1 at the front end portion. An upper surface 106*a* of the flow regulating member 106 may be parallel to the chord line L1. The chord line L1 may be parallel to the virtual line L2.

According to the first modified example, since the upper surface 106*a* of the flow regulating member 106 is parallel to the chord line L1, the following effects are achieved. The shape of the flow regulating member 106 can be simplified as compared with a case in which the flow regulating member has a bulging portion.

A second modified example of the embodiment will be described.

In the embodiment, the case in which the flow regulating member 6 has the airfoil shape has been described, but the present embodiment is not limited thereto.

Figure 9:
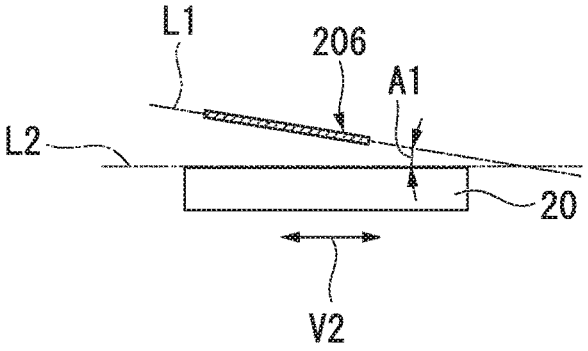
FIG. 9 is a view showing a flow regulating member of a second modified example of the embodiment together with a paper bundle.

FIG. 9 is a view showing a flow regulating member 206 of the second modified example of the embodiment together with the paper bundle 20. FIG. 9 corresponds to FIG. 4 in which a cross section of the flow regulating member 6 taken along line II-II of FIG. 1 is viewed from the first direction V1. In FIG. 9, the paper feed tray 2, the blower 4, and the like are omitted.

As shown in FIG. 9, the flow regulating member 206 may have a flat plate shape. The elevation angle A1 of the flow regulating member 206 is positive.

According to the second modified example, since the flow regulating member 206 has a flat plate shape, the following effects are achieved. The shape of the flow regulating member 206 can be simplified as compared with a case in which the flow regulating member has an airfoil shape.

A third modified example of the embodiment will be described.

In the embodiment, the case in which the flow regulating member 6 has a continuous airfoil shape without a gap has been described, but the present embodiment is not limited thereto.

Figure 10:
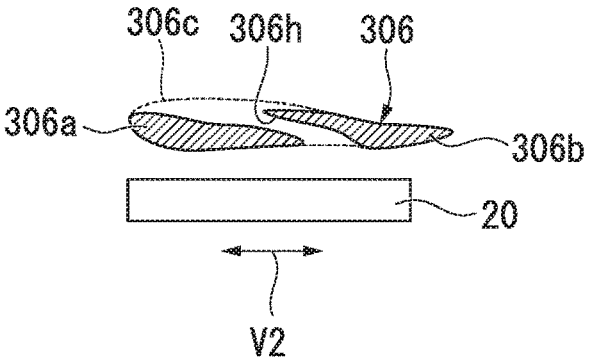
FIG. 10 is a view showing a flow regulating member of a third modified example of the embodiment together with a paper bundle.

FIG. 10 is a view showing a flow regulating member 306 of the third modified example of the embodiment together with the paper bundle 20. FIG. 10 corresponds to FIG. 4 in which a cross section of the flow regulating member 6 taken along line II-II of FIG. 1 is viewed from the first direction V1. In FIG. 10, illustrations of the paper feed tray 2, the blower 4, and the like are omitted.

As shown in FIG. 10, the flow regulating member 306 may have a segmented airfoil shape having a gap 306*h*.

The flow regulating member 306 includes a first flow regulating portion 306*a*, a second flow regulating portion 306*b*, and a coupling portion 306*c*.

The first flow regulating portion 306*a* is positioned on a front side of the flow regulating member 306.

The second flow regulating portion 306*b* is positioned on a rear side of the flow regulating member 306.

The coupling portion 306*c* couples the first flow regulating portion 306*a* and the second flow regulating portion 306*b*. The coupling portion 306*c* is positioned at an end portion in an extending direction of the flow regulating member 306.

A gap 306*h* is provided between the first flow regulating portion 306*a* and the second flow regulating portion 306*b*. In the cross-sectional view of FIG. 10, the gap 306*h* is curved to be positioned lower toward the rear side.

According to the third modified example, since the flow regulating member 306 has a segmented airfoil shape having the gap 306*h*, the following effects are achieved. It is possible to send airflow between the flow regulating member 306 and the uppermost sheet of paper 21 via the gap 306*h*. Therefore, the air flow rate flowing between the flow regulating member 306 and the uppermost sheet of paper 21 can be increased as compared with a case in which a flow regulating member has a continuous airfoil shape without a gap.

A fourth modified example of the embodiment will be described.

In the embodiment, the case in which the flow regulating member 6 is fixed to the fixed position has been described, but the present embodiment is not limited thereto.

Figure 11:
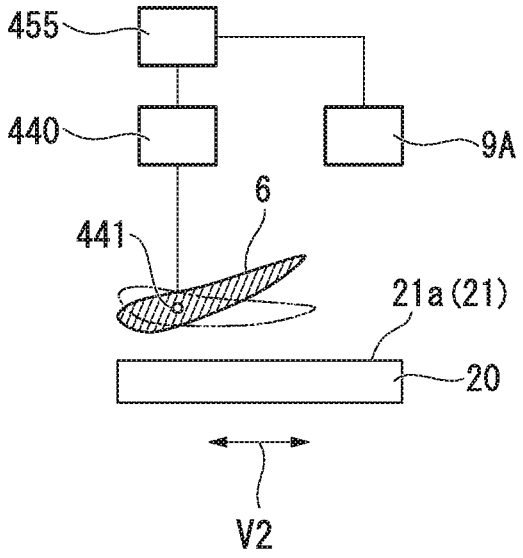
FIG. 11 is a view showing a flow regulating member of a fourth modified example of the embodiment together with a paper bundle.

FIG. 11 is a view showing the flow regulating member 6 of the fourth modified example of the embodiment together with the paper bundle 20. FIG. 11 corresponds to FIG. 4 in which a cross section of the flow regulating member 6 taken along line II-II of FIG. 1 is viewed from the first direction V1. In FIG. 11, the paper feed tray 2, the blower 4, and the like are omitted.

As shown in FIG. 11, an elevation angle of the flow regulating member 6 may be changeable.

The paper feeding device of the present modified example further includes an elevation angle varying mechanism 440 and an elevation angle controller 455.

The elevation angle varying mechanism 440 can change the elevation angle of the flow regulating member 6. The elevation angle varying mechanism 440 is attached to the flow regulating member 6. The elevation angle varying mechanism 440 rotates the flow regulating member 6 around a support shaft 441. For example, the elevation angle varying mechanism 440 includes a motor capable of rotating forward and backward.

The elevation angle controller 455 controls the elevation angle varying mechanism 440 on the basis of the detection result of the top plate side paper position detector 9A. For example, the elevation angle controller 455 determines the mass of the uppermost sheet of paper 21 from a rising-up amount of the uppermost sheet of paper 21 or the like on the basis of the detection result of the top plate side paper position detector 9A.

For example, when the uppermost sheet of paper 21 is heavier than a preset threshold value (hereinafter referred to as a "mass threshold value"), the elevation angle controller 455 sets the elevation angle to be positive, and thereby facilitating generation of a negative pressure between the upper surface 21*a* of the uppermost sheet of paper 21 and the flow regulating member 6.

For example, when the uppermost sheet of paper 21 is lighter than the mass threshold value, the elevation angle controller 455 sets the elevation angle to be negative, thereby making it difficult for a negative pressure to be generated between the upper surface 21*a* of the uppermost sheet of paper 21 and the flow regulating member 6.

According to the fourth modified example, since the elevation angle varying mechanism 440 capable of changing the elevation angle of the flow regulating member 6 is provided, the following effect is achieved. It is possible to adjust a magnitude of the negative pressure generated between the upper surface 21*a* of the uppermost sheet of paper 21 and the flow regulating member 6 as compared with the case in which the flow regulating member 6 is fixed at the fixed position.

Also, since the paper feeding device includes the elevation angle controller 455 which controls the elevation angle varying mechanism 440 on the basis of the detection result of the top plate side paper position detector 9A, the following effects are achieved. Since the elevation angle can be changed according to the position of the uppermost sheet of paper 21, the uppermost sheet of paper 21 can be stably separated from the paper bundle 20 placed on the paper feed tray 2. For example, the mass of the uppermost sheet of paper 21 is determined from a rising-up amount of the uppermost sheet of paper 21 or the like, and when the uppermost sheet of paper 21 is heavier than the mass threshold value, the elevation angle can be set to plus. Therefore, a decrease in action of the flow regulating member 6 (rising-up effect) due to a weight of the uppermost sheet of paper 21 can be prevented.

Further, the elevation angle controller 455 is not limited to determining the mass of the uppermost sheet of paper 21 from the rising-up amount of the uppermost sheet of paper 21 and the like. For example, the elevation angle controller 455 may determine the mass of the uppermost sheet of paper 21 from an imaging result of a camera or the like which images the uppermost sheet of paper 21.

A fifth modified example of the embodiment will be described.

In the embodiment, the case in which the flow regulating member 6 is fixed to the fixed position has been described, but the present embodiment is not limited thereto.

Figure 12:
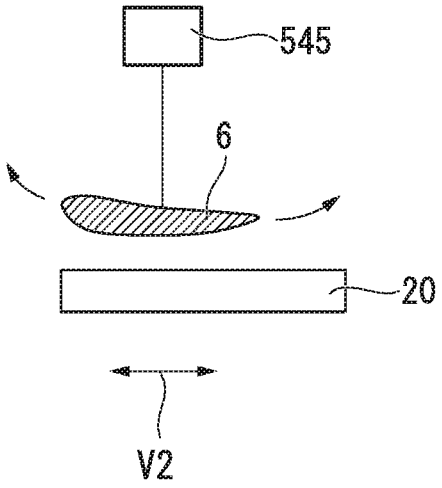
FIG. 12 is a view showing a flow regulating member of a fifth modified example of the embodiment together with a paper bundle.

FIG. 12 is a view showing the flow regulating member 6 of the fifth modified example of the embodiment together with the paper bundle 20. FIG. 12 corresponds to FIG. 4 in which a cross section of the flow regulating member 6 taken along line II-II of FIG. 1 is viewed from the first direction V1. In FIG. 12, the paper feed tray 2, the blower 4, and the like are omitted.

As shown in FIG. 12, the flow regulating member 6 may be swingable. A swing mechanism 545 capable of swinging the flow regulating member 6 is attached to the flow regulating member 6. For example, the swing mechanism 545 is a slider crank mechanism.

According to the fifth modified example, since the swing mechanism 545 capable of swinging the flow regulating member 6 is provided, the following effect is achieved. It is possible to change a magnitude of the negative pressure generated between the upper surface 21*a* of the uppermost sheet of paper 21 and the flow regulating member 6 as compared with the case in which the flow regulating member 6 is fixed at the fixed position.

A sixth modified example of the embodiment will be described.

In the embodiment, the case in which a plurality of the flow regulating members 6 are disposed above the paper bundle 20 placed on the paper feed tray 2 has been described, but the present embodiment is not limited thereto.

Figure 13:
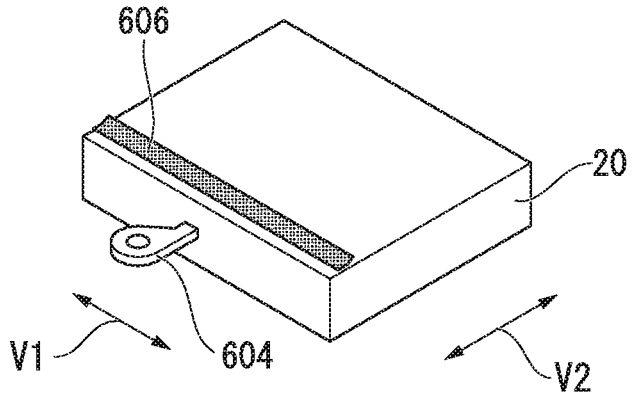
FIG. 13 is a view showing a flow regulating member of a sixth modified example of the embodiment together with a paper bundle and a blower.

FIG. 13 is a view showing a flow regulating member 606 of the sixth modified example of the embodiment together with the paper bundle 20 and a blower 604. In FIG. 13, an illustration of the paper feed tray 2 or the like is omitted.

As shown in FIG. 13, only one flow regulating member 606 may be disposed above the paper bundle 20. The flow regulating member 606 is disposed on one side in the paper width direction above the paper bundle 20.

According to the sixth modified example, since only one flow regulating member 606 is disposed above the paper bundle 20, the following effect is achieved. It is possible to reduce the number of parts and costs as compared with the case in which a plurality of the flow regulating members 606 are disposed above the paper bundle 20.

A seventh modified example of the embodiment will be described.

In the embodiment, the case in which the flow regulating member 6 continuously extends in the first direction V1 has been described, but the present embodiment is not limited thereto.

Figure 14:
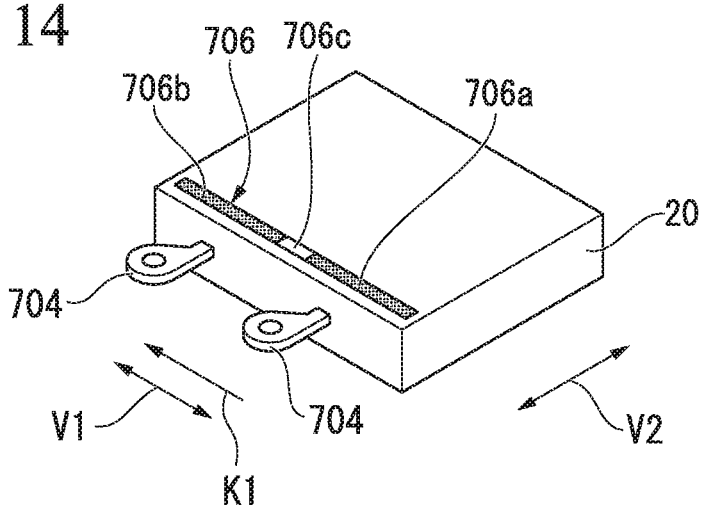
FIG. 14 is a view showing a flow regulating member of a seventh modified example of the embodiment together with a paper bundle and a blower.

FIG. 14 is a view showing a flow regulating member 706 of the seventh modified example of the embodiment together with the paper bundle 20 and a blower 704. In FIG. 14, an illustration of the paper feed tray 2 or the like is omitted.

As shown in FIG. 14, the flow regulating member 706 may be segmented and extend in the first direction V1.

The flow regulating member 706 includes a first flow regulating portion 706*a*, a second flow regulating portion 706*b*, and a coupling portion 706*c*.

The first flow regulating portion 706*a* is positioned on the upstream side in the paper conveying direction K1.

The second flow regulating portion 706*b* is positioned on the downstream side in the paper conveying direction K1.

The coupling portion 706*c* couples the first flow regulating portion 706*a* and the second flow regulating portion 706*b*. The coupling portion 706*c* is positioned between the first flow regulating portion 706*a* and the second flow regulating portion 706*b*.

Two blowers 704 are disposed next to the paper bundle 20 placed on the paper feed tray 2. The two blowers 704 are respectively positioned next to the first flow regulating portion 706*a* and the second flow regulating portion 706*b*.

According to the seventh modified example, since the flow regulating member 706 is segmented and extends in the first direction V1, the following effect is achieved. It is possible to send airflow between the segmented flow regulating members 706 (the first flow regulating portion 706*a* and the second flow regulating portion 706*b*) and the uppermost sheet of paper 21. For example, even when a paper size is larger than a preset threshold value (hereinafter referred to as a "size threshold value") (for example, A3 size or more), the uppermost sheet of paper 21 can be stably separated.

An eighth modified example of the embodiment will be described.

Figure 15:
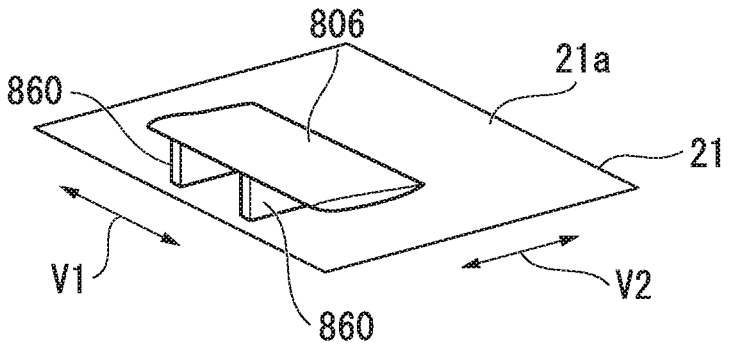
FIG. 15 is a perspective view showing a flow regulating member of an eighth modified example of the embodiment.

FIG. 15 is a perspective view showing a flow regulating member 806 of the eighth modified example of the embodiment.

As shown in FIG. 15, a plurality of protruding portions 860 protruding downward may be provided in the flow regulating member 806.

In FIG. 15, two protruding portions 860 are shown. The number of protruding portions 860 may be one, three or more.

The protruding portions 860 protrude from a lower surface of the flow regulating member 806 toward the uppermost sheet of paper 21. Lower ends of the protruding portions 860 are separated from the upper surface 21*a* of the uppermost sheet of paper 21. The two protruding portions 860 are disposed at an interval in the first direction V1. The protruding portions 860 extend in the second direction V2. The protruding portions 860 have a plate shape having a thickness in the first direction V1.

According to the eighth modified example, since the protruding portions 860 protruding downward are provided in the flow regulating member 806, the following effect is achieved. The protruding portions 860 can restrain excessive rising-up of the uppermost sheet of paper 21.

A ninth modified example of the embodiment will be described.

In the eighth modified example of the embodiment, the case in which the protruding portions 860 have a plate shape has been described, but the present embodiment is not limited thereto.

Figure 16:
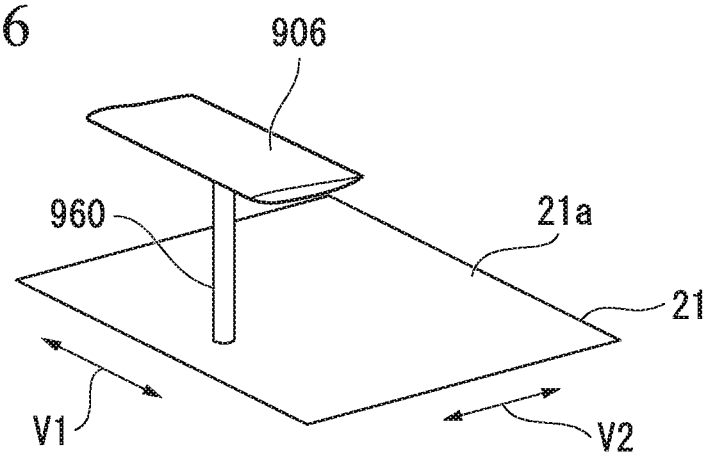
FIG. 16 is a perspective view showing a flow regulating member of a ninth modified example of the embodiment.

FIG. 16 is a perspective view showing a flow regulating member 906 of the ninth modified example of the embodiment.

As shown in FIG. 16, a protruding portion 960 may have a columnar shape extending from a lower surface of the flow regulating member 906 toward the uppermost sheet of paper 21. A lower end of the protruding portion 960 is separated from the upper surface 21*a* of the uppermost sheet of paper 21.

In FIG. 16, one protruding portion 960 is shown. The number of protruding portions 960 may be two or more. For example, a plurality of protruding portions 960 may be disposed at intervals in the first direction V1 or the second direction V2.

According to the ninth modified example, since the protruding portion 960 protruding downward is provided in the flow regulating member 906, the following effect is achieved. The protruding portion 960 can restrain excessive rising-up of the uppermost sheet of paper 21.

Further, in the above-described embodiment, a case in which the paper feeding device is applied to an image forming device such as a printer has been described, but the present embodiment is not limited thereto. For example, the paper feeding device may be applied to financial instruments, postal sorting machines, printing machines, copying machines, facsimile machines, multi-function peripherals, and the like. Further, the multi-function peripherals may be for business use or office use and include various types of paper.

Further, in the above-described embodiment, the case in which the flow regulating member extends in the direction parallel to the paper conveying direction has been described, but the present embodiment is not limited thereto. For example, the flow regulating member may extend in a direction intersecting the paper conveying direction.

Further, in the above-described embodiment, the case in which the flow regulating member extends in a direction parallel to the longitudinal direction of the paper has been described, but the present embodiment is not limited to this. For example, the flow regulating member may extend in a direction intersecting the longitudinal direction of the paper.

Further, in the above-described embodiment, the case in which two flow regulating members are disposed above the paper bundle has been described, but the present embodiment is not limited thereto. For example, three or more flow regulating members may be disposed above the paper bundle.

Further, in the above-described embodiment, the case in which the blocking members which block airflow from the blower are provided at opposite ends of the flow regulating member has been described, but the present embodiment is not limited thereto. For example, no blocking member may be provided at opposite ends of the flow regulating member. For example, opposite ends of the flow regulating member may be directly supported by the frame.

Further, in the above-described embodiment, the case in which the flow regulating member is supported by the frame has been described, but the present embodiment is not limited thereto. For example, the flow regulating member may be supported by the cassette.

Further, in the above-described embodiment, the case in which the airfoil side paper position detector, the heater, the sensor, and the static eliminator are embedded in the flow regulating member has been described, but the present embodiment is not limited thereto. For example, at least one of the airfoil side paper position detector, the heater, the sensor, and the static eliminator may be externally attached to the flow regulating member. Alternatively, at least one of the airfoil side paper position detector, the heater, the sensor, and the static eliminator may be supported by a member other than the flow regulating member such as the frame and the cassette.

Further, in the above-described embodiment, the case in which the blower is fixed at the fixed position has been described, but the present embodiment is not limited thereto. For example, the blower may be movable in an extending direction of the flow regulating member. Since the blower is movable in the extending direction of the flow regulating member, even when the paper size is larger than the size threshold value, the uppermost sheet of paper can be stably separated.

Also, in the above-described embodiment, the case in which the relative position varying mechanism changes the distance between the upper surface of the uppermost sheet of paper and the flow regulating member by vertically moving the cassette in a state in which the flow regulating member is at the fixed position has been described, but the present embodiment is not limited thereto. For example, the relative position varying mechanism may change the position of the flow regulating member with respect to the uppermost sheet of paper by moving the flow regulating member in a virtual plane (in a vertical plane) perpendicular to the extending direction of the flow regulating member in a state in which the paper feed tray is at a regular position. Since the flow regulating member is moved, it is possible to prevent the flow regulating member from causing a becoming when taking out the cassette.

For example, the relative position controller may control the relative position varying mechanism on the basis of a processing speed. The faster the processing speed, the wider the distance between the upper surface of the uppermost sheet of paper and the flow regulating member. For example, the relative position controller may move the flow regulating member toward the upper surface of the uppermost sheet of paper by an amount corresponding to an increase in the distance between the upper surface of the uppermost sheet of paper and the flow regulating member.

Further, in the above-described embodiment, the case in which the sensor can detect a temperature and humidity of the uppermost sheet of paper has been described, but the present embodiment is not limited thereto. For example, the sensor may be able to detect only a temperature of the uppermost sheet of paper. Alternatively, the sensor may be able to detect only humidity of the uppermost sheet of paper. That is, the sensor may be capable of detecting at least one of the temperature and humidity of the uppermost sheet of paper.

Further, in the above-described embodiment, the case in which the system control unit controls each element of the blower, the elevation angle varying mechanism, the relative position varying mechanism, the heater, and the static eliminator has been described, but the present embodiment is not limited thereto. For example, at least one of the above elements may be manually operated.

According to at least one embodiment described above, it is possible to provide a paper feeding device 1 capable of separating the uppermost sheet of paper 21 from the paper bundle 20 placed on the paper feed tray 2 by including the paper feed tray 2 on which the paper bundle 20 in which a plurality of sheets of paper are stacked can be placed, the blower 4 positioned next to the paper bundle 20 placed on the paper feed tray 2 and capable of generating airflow, and the flow regulating member 6 positioned above the paper bundle 20 placed on the paper feed tray 2 and generating a negative pressure between the flow regulating member 6 and the uppermost sheet of paper 21 of the paper bundle 20 by the airflow from the blower 4.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper feeding device comprising:

a paper feed tray on which a paper bundle in which a plurality of sheets of paper are stacked is able to be placed;

a blower positioned next to the paper bundle placed on the paper feed tray and able to generate airflow; and a plurality of flow regulating members positioned above the paper bundle placed on the paper feed tray, the flow regulating members generating a negative pressure between the flow regulating members and an uppermost sheet of paper of the paper bundle with the airflow from the blower, wherein the plurality of flow regulating members includes a first flow regulating member disposed on a first side in a paper width direction above the paper bundle and a second flow regulating member disposed on a second side opposite to the first side in the paper width direction above the paper bundle.

2. The paper feeding device according to claim 1, wherein each of the plurality of flow regulating members has an airfoil shape.

3. The paper feeding device according to claim 1, wherein each of the plurality of flow regulating members extends in a direction parallel to a conveying direction of the paper.

4. The paper feeding device according to claim 1, wherein each of the plurality of flow regulating members extends in a direction parallel to a longitudinal direction of the paper.

5. The paper feeding device according to claim 1, wherein:

each of the plurality of flow regulating members extends in a direction parallel to an upper surface of the uppermost sheet of paper; and the paper feeding device further comprises a plurality of pairs of blocking members which block the airflow from the blower, wherein each pair of the blocking members is provided on opposite ends of a corresponding one of the plurality of flow regulating members, respectively, such that the airflow passes between the upper surface of the uppermost sheet of paper and the corresponding one of the plurality of flow regulating members.

6. The paper feeding device according to claim 1, wherein a paper position detection unit which is able to detect a position of the uppermost sheet of paper is provided in at least one of the plurality of flow regulating members.

7. The paper feeding device according to claim 6, further comprising an air flow rate controller which controls an air flow rate of the blower on the basis of a detection result of the paper position detection unit.

8. The paper feeding device according to claim 1, further comprising an elevation angle varying mechanism which is able to change an elevation angle of each of the plurality of flow regulating members.

9. The paper feeding device according to claim 8, further comprising:

a paper position detection unit which is able to detect a position of the uppermost sheet of paper; and an elevation angle controller which controls the elevation angle varying mechanism on the basis of the detection result of the paper position detection unit.

10. The paper feeding device according to claim 1, further comprising a relative position varying mechanism which is able to change a relative position between each of the plurality of flow regulating members and the paper feed tray.

11. The paper feeding device according to claim 10, further comprising:

a paper position detection unit which is able to detect a position of the uppermost sheet of paper; and a relative position controller which controls the relative position varying mechanism on the basis of the detection result of the paper position detection unit.

12. The paper feeding device according to claim 1, wherein a heater which is able to heat the uppermost sheet of paper is provided in at least one of the plurality of flow regulating members.

13. The paper feeding device according to claim 12, further comprising:

a sensor which is able to detect at least one of a temperature and humidity of the uppermost sheet of paper; and a heating output controller which controls an output of the heater such that the output of the heater is in accordance with an air flow rate of the blower on the basis of a detection result of the sensor.

14. The paper feeding device according to claim 1, wherein a static eliminator which is able to remove static electricity of the uppermost sheet of paper is provided in at least one of the plurality of flow regulating members.

15. The paper feeding device according to claim 14, further comprising:

a sensor which is able to detect at least one of a temperature and humidity of the uppermost sheet of paper; and a voltage output controller which controls an output of the static eliminator such that the output of the static eliminator is in accordance with an air flow rate of the blower on the basis of the detection result of the sensor.

* * * * *